US005586582A

United States Patent [19]

Nakada

[11] Patent Number: 5,586,582

[45] Date of Patent: Dec. 24, 1996

[54] SUPPORT ASSEMBLY FOR A PLANETARY-TYPE SELVAGE UNIT ON A LOOM

[75] Inventor: Yasuo Nakada, Ishikawa-ken, Japan

[73] Assignee: Tsudakoma Kogyo Kabushiki Kaisha, Japan

[21] Appl. No.: 469,661

[22] Filed: Jun. 6, 1995

[30] Foreign Application Priority Data

Sep. 27, 1994 [JP] Japan ..... 6-257443

[51] Int. Cl.[6] ..... D03D 47/40

[52] U.S. Cl. ..... 139/430; 139/1 R; 74/384

[58] Field of Search ..... 74/384; 139/430, 139/1 R

[56] References Cited

U.S. PATENT DOCUMENTS 5,307,845 5/1994 Vanrobaeys et al. ..... 139/430

5,392,819 2/1995 Lin ..... 139/430

*Primary Examiner*—Andy Falik

*Attorney, Agent, or Firm*—Cobrin Gittes & Samuel

[57] ABSTRACT

A support shaft for a planetary-type selvage unit on a loom is mounted at its proximal end to a drive shaft for the selvage unit in an arrangement swingable between operative and stand-by positions. A locker unit is attached to the support bracket in order to selectively register the same at the operative position during weaving operation. Simple swing motion of the support bracket about the drive shaft produces an enlarged free space above the selvage unit during the looming operation, thereby allowing free transportation of heald frames necessary for the looming operation.

4 Claims, 5 Drawing Sheets

SUPPORT ASSEMBLY FOR A PLANETARY-TYPE SELVAGE UNIT ON A LOOM

BACKGROUND OF THE INVENTION

The present invention relates to a support assembly for a planetary gear train type selvage unit (hereinafter referred to "a planetary-type selvage unit") on a loom. More particularly, the invention relates to improvements in suitability of such a planetary-type selvage unit to accommodate a shift in production scheme, more specifically to a change in type of fabrics, on a weaving loom.

In general, a planetary-type selvage unit is fixed at its lateral ends to a framework of a loom at positions corresponding to the reeding width of fabrics to be woven on the loom. The distance between the fixed lateral ends of the planetary-type selvage unit is smaller than the width of heald frames used for weaving the fabrics.

When warps on a warp beam are fully consumed because of the advance of weaving or because the production scheme is to be shifted, an old warp beam combined with an old set of elements for passing warps delivered from the old warp beam has to be exchanged with a new warp beam combined with a new set of elements for passing warps from the new warp beam. This exchange is generally called "looming operation". The set of the element generally includes heald frames, a dropper box and a reed. In such a looming operation, the new set of elements is mounted to the loom sequentially from the warp let-off motion side to the cloth take-up side on the loom.

As is well known, a planetary-type selvage unit is mounted to a loom at a position closer to the let-off motion side than the position at which the heald frames are mounted to the loom. Consequently, the planetary-type selvage unit is mounted to the loom before mounting of the heald frames. So, for mounting the heald frames to the loom, the heald frames must be transported forwards, i.e. towards the take-up side, across a space over the planetary-type selvage unit.

Conventionally, the planetary-type selvage unit is fixedly mounted to the loom without any possibility of changing its height. Thus, the height of the planetary-type selvage unit remains unchanged throughout the weaving operation and the looming operation. As a consequence, during the looming operation, the heald frames need to be held high above the planetary-type selvage unit to avoid an undesired crashings into each other during their forward transportation.

In the design of a carriage used for automatic looming operation, the carriage has a construction capable of having the heald frame at a high position to enable the above-described transportation above the planetary-type selvage unit. In other words, the construction of the carriage is un-desirably enlarged. In addition, such a top-heavy construction impairs operation stability of the carriage which is quite un-welcome from the viewpoint of operation safety. Further an increase in manufacturing cost and low operability are caused by such a top heavy construction.

When looming operation is carried out manually, the heald frames must be lifted high above the planetary-type selvage unit, which entails increased labor associated with low level of operation safety.

When an accessory such as an overlay-type Dobby shedding machine is arranged overhead the loom, a remaining space above the loom is too small to transport the heald frames in an upright position. Thus, the heald frames have to be kept in a somewhat inclined or horizontal position during the forward transportation above the planetary-type selvage unit. The heald frames are usually carried on a carriage in an upright position. Thus, upon unloading from the carriage, the heald frames have to be changed to a horizontal position by manual operation, conveyed across a space overhead the planetary-type selvage unit, and returned to the upright position after completion of conveyance. Such a complicated manual operation poses increased load on an operator and necessitates elongated operation time.

From the foregoing, it is well understood that the conventional planetary-type selvage unit is very much unsuited for looming operation and, as a consequence, very poorly suited to accommodate a shift in production scheme.

SUMMARY OF THE INVENTION

It is the object of the present invention to enhance suitability of a planetary-type selvage unit to the looming operation necessary for accommadating shift in production scheme.

In accordance with the present invention, a support bracket for a planetary-type selvage unit is mounted at its proximal end to a drive shaft for the selvage unit to swing between operative and stand-by positions. A locker unit is attached to the support bracket to selectively register the same at the operative position during weaving operation.

DESCRIPTION OF THE PREFERRED EMBODIMENTS

Figure 1:
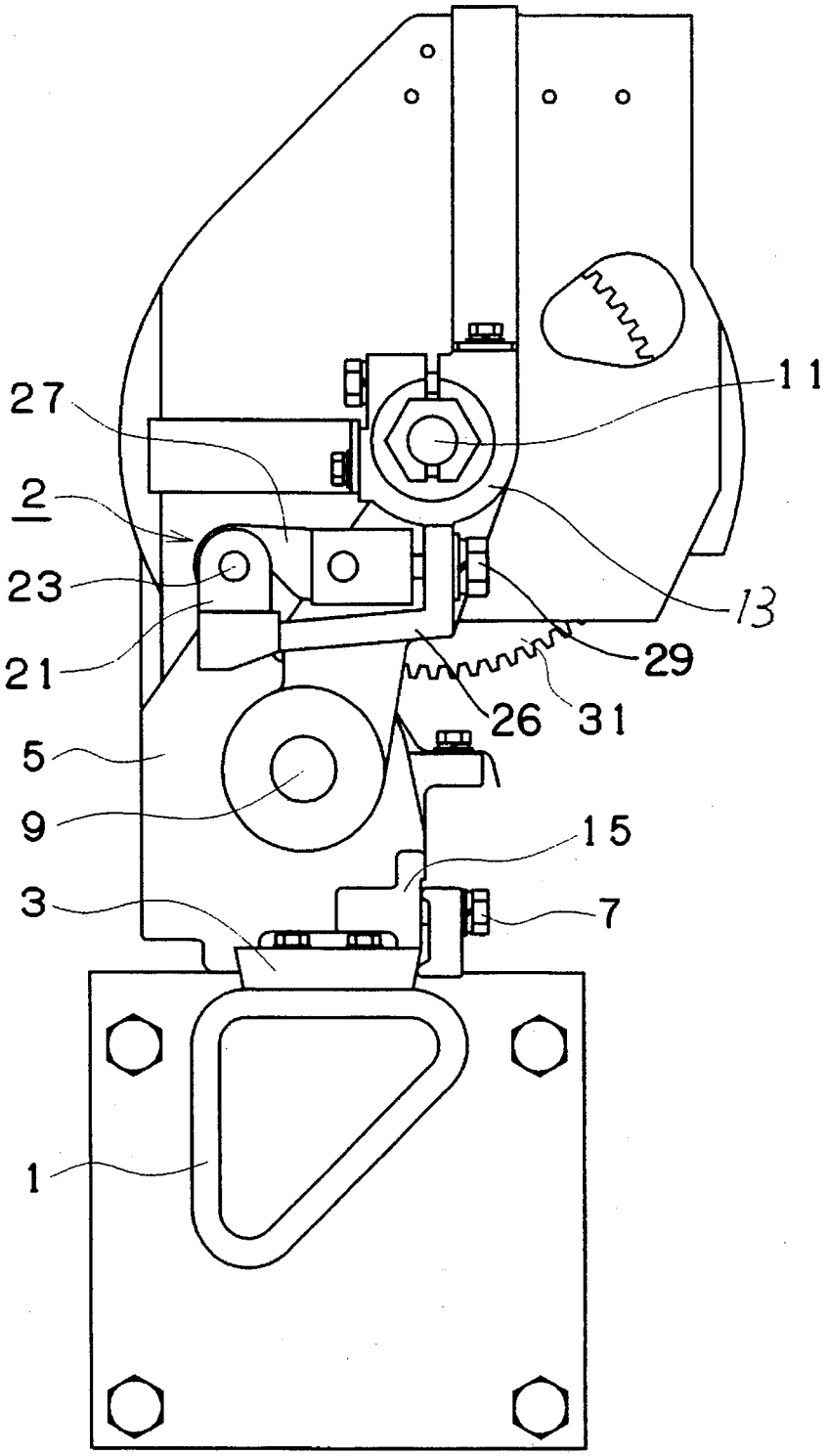
FIG. 1 is a side view of an embodiment of the support assembly in accordance with the present invention in the operative position.
Figure 3:
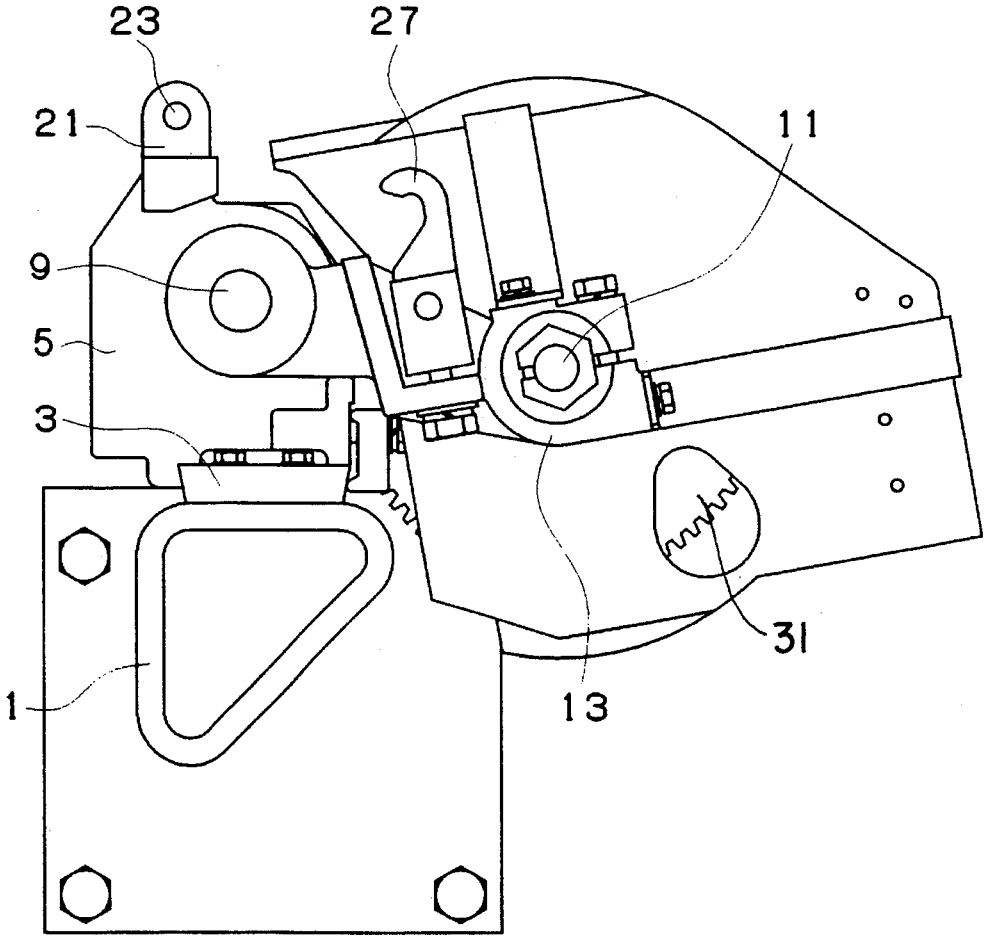
FIG. 3 is a side view of the support unit in the stand-by position.

An embodiment of the support assembly in accordance with the present invention is shown in FIGS. 1 and 3, in which, though not illustrated, a warp let-off assembly is arranged on the right side and a cloth take-up assembly is arranged on the left side. Stated otherwise, heald frames (not shown) should be arranged on the left side of the support assembly in the illustration.

A slide base 5 is coupled to a slide rail 3 fixed atop a back top stay 1 of a loom in an arrangement slidable in the width direction of the loom. The slide base 5 is registered at any selected positions corresponding to the feeding width of the production scheme by assistance of fastener bolts 7 (see FIG. 2).

Figure 2:
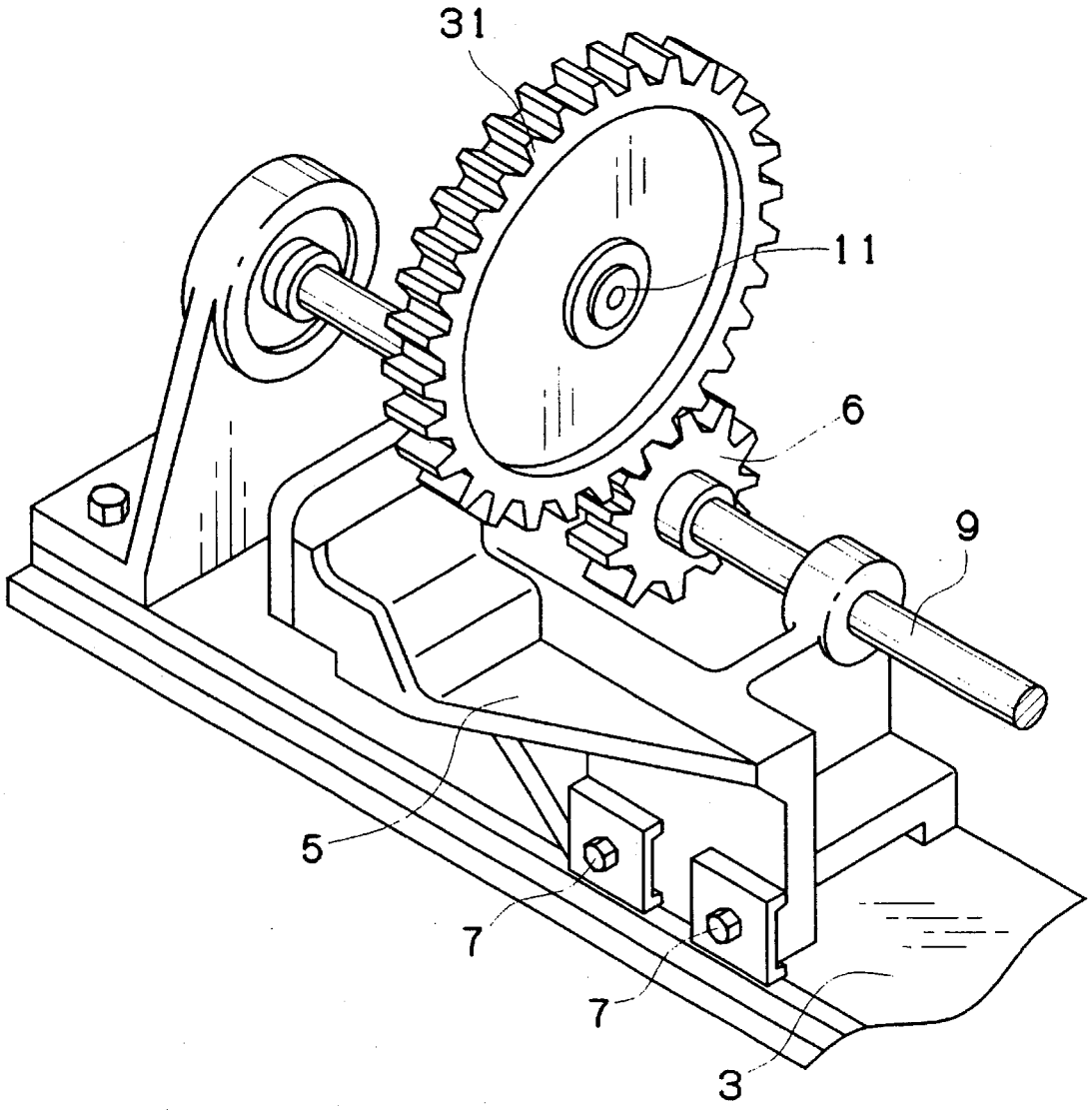
FIG. 2 is a perspective view, partly omitted for clearer representation, of the planetary-type selvage unit incorporating the present invention.

The slide base 5 rotatably carries a drive shaft 9 for a planetary-type selvage unit which includes, as best seen in FIG. 2, a selvage gear 31 arranged in meshing engagement with a drive gear 6 mounted on the drive shaft 9. An upwardly extending support bracket 13 is swingably mounted at its proximal end to the section of the drive shaft 9 projecting from the slide base 5. In the position shown in FIG. 1, the support bracket 13 is registered at an operative position suited for weaving operation.

A stopper 15 is attached to the lower section of the slide base 5 in order to fix the support bracket 13 to a stand-by position of the support bracket 13 during looming operation.

The distal end of the support bracket 13 is secured to a sun shaft 11 for a selvage gear 31 and a sun gear (not shown) of the planetary-type selvage unit. That is, all elements of the planetary-type selvage unit such as the selvage gear 31, the sun gear, planet gears (not shown) in meshing engagement with the sun gear, supported on the selvage gear 31, and the selvage gear 31 and planetary and selvage covers are carried by the support bracket 13.

As stated above, the position of the support bracket 13 during the looming operation is fixed by the stopper 15 whereas its position during the weaving operation is fixed by a locker unit.

Figure 4:
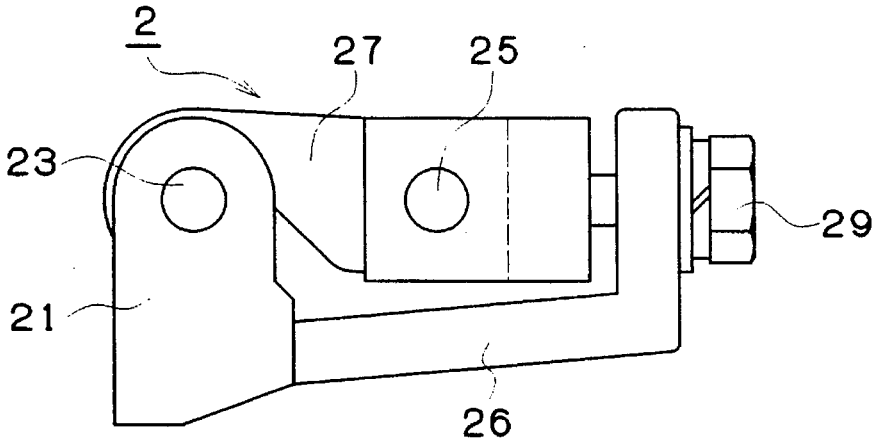
FIG. 4 is an enlarged side view of one example of the locker unit used for the support assembly shown in FIG. 1.
Figure 5:
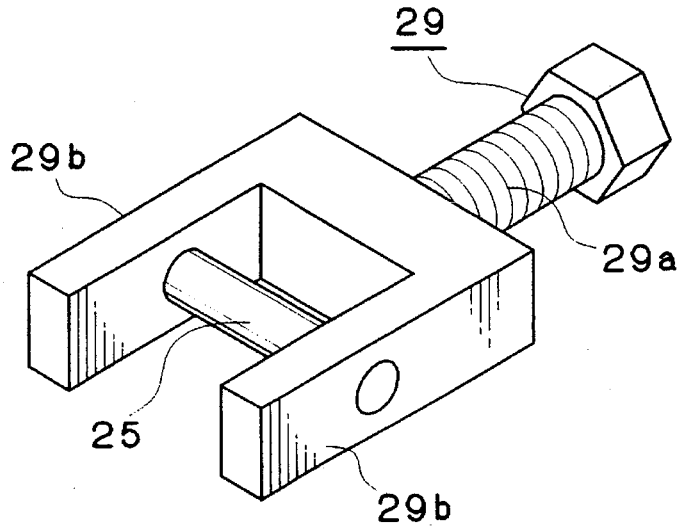
FIG. 5 is a perspective view of a part of the locker unit shown in FIG. 4.

One example of such a locker unit is shown in FIGS. 4 and 5. The locker unit 2 includes a pin stand 21 fixedly mounted atop the slide base 5 whilst carrying a horizontal pin 23. An arm 26 projects from the side face of the support bracket 13 and carries, at its vertical section, a fixed bolt 29 via screw engagement. The fixer bolt 29 extends horizontally towards the pin stand 21 and the arm 26 abuts against the pin stand 21 when the support bracket 13 is registered at the operative position shown in FIG. 1. As best seen in FIG. 5, the fixer bolt 29 has a threaded section **29*a* for screw engagement with the arm 26 and is bifurcated at its distal end. Two branch sections 29*b* of the bifurcated construction carry a horizontal pivot 25 which extends in parallel to the pin 23 carried by the pin stand 21. A hook 27 is swingably mounted to the pivot 25. When the support bracket 13 is registered at the operative position, the hook 27 rests in engagement with the pin 23 on the slide base 5 and the planetary-type selvage unit is placed in an upright position. This position is maintained through fastening of the fixer bolt 29**.

The support assembly of the above-described construction operates as follows. As stated above, the entire system is kept in the operative position shown in FIG. 1 during weaving operation on the loom. In this position, the support bracket 13 is registered at the operative position by assistance of the locker unit 2, the planetary-type selvage unit is kept in the upright position and the hook 27 of the locker unit 2 is kept in engagement with the pin 23 on the slide base 5.

The position of the entire system during looming operation is shown in FIG. 3. At shift from the operative to the stand-by position, locking by the locker unit 2 is first cancelled and the support bracket 13 is then swung clockwise in the illustration. That is, the support bracket 13 is swung towards the warp let-off side. More specifically, the fixer bolt 29 is first loosened to allow free swing of the hook 27. Then, the hook 27 is swung upwards out of engagement with the pin 23 on the slide base 5. Under this condition, the support bracket 13 is swung towards the warp let-off side to bring the planetary-type selvage unit into the falling position shown in FIG. 3. Thus, the entire system is brought out of the course of transportation of heald frames. As a result, a sufficiently large space is reserved above the planetary-type selvage unit whilst allowing free and easy looming operation.

At shift from the stand-by to operative position, the support bracket 13 is first swung towards the cloth take-up side and the locking by the locker unit 2 is then revived. More specifically, the support bracket 18 is swung towards the cloth take-up side, the hook 27 on the support bracket 13 is brought into engagement with the pin 23 on the slide base 5 and the engagement is fastened by the fixer bolt 29.

At the above-described shifts between the operative and stand-by positions, the support bracket 13 carrying the sun shaft 11 for the selvage gear 31 swings about the drive shaft 9 for the drive gear 6. Therefore, the distance between the center of the selvage gear 31 and the center of the drive gear 6 is maintained unchanged during the shift in position. As a consequence, the shift in position of the planetary-type selvage unit can be carried out without necessitating disengagement of the two gears 6 and 31.

As a substitute for the fixer bolt 29 used in the foregoing embodiment, a one-touch type stopper may be used for the locker unit 2 for an easier operation and a shorter operation time.

The above-described locker unit 2 incorporating a pin-hook combination tends to vibrate due to unavoidable presence of a play between the hook 27 and the pin 23. In order to minimize such vibration, another example of the locker unit employs a different construction shown in FIGS. 6 and 7.

The locker unit 4 of this example is made up of a pin stand 41 mounted atop the slide base 5, an arm 45 attached sideways to the support bracket 13, a fixer bolt 45 and a nut 47 for screw engagement with the fixer nut 45.

The pin stand 41 has a groove 41a opening upwards and extending through the body of the pin stand 41. The arm 43 has an angled through hole **43*a*. The arm 43 is attached to the side face of the support bracket 13 in an arrangement such that it abuts against the pin stand 41 and that its hole 43*a* is in axial alignment with the groove 41*a* in the pin stand 41, both when the support bracket 13 is registered at the operative position. The fixer bolt 45 includes a flange section 45*a* adapted for abutment against the arm 43, an angled section 45*b* adapted for tight engagement with the hole 43*a* in the arm 43, and a threaded section 45*c* adapted for screw engagement with the nut 47. The upper wall of the hole 43*a* in the arm 43 diverges towards the pin stand 41 in order to allow upward swing of the fixer bolt 45**.

Figure 6:
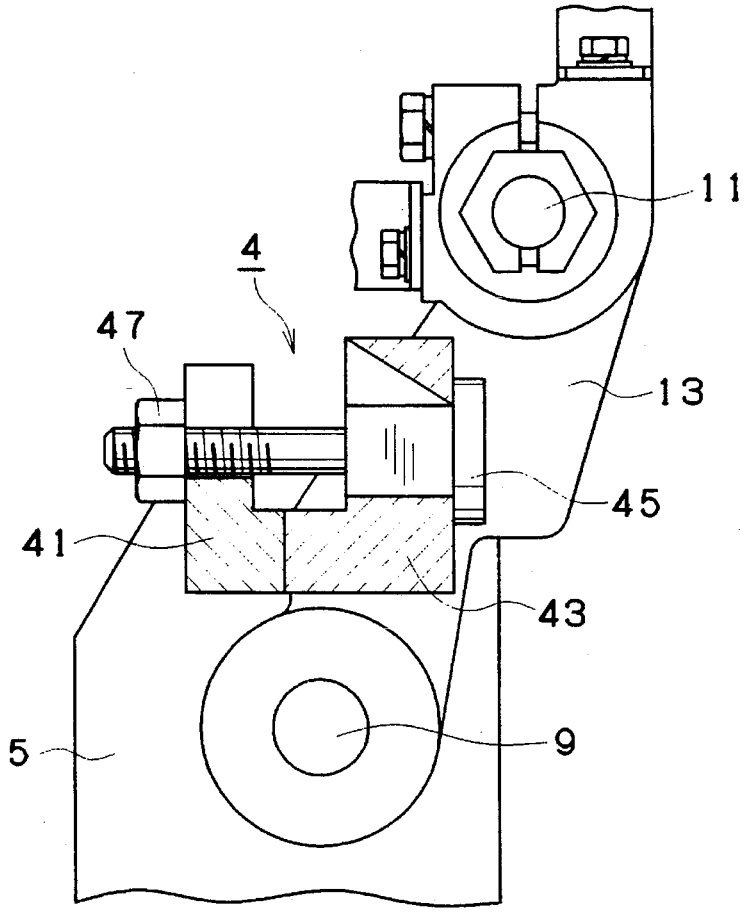
FIG. 6 is an enlarged, side view, partly in section, of another example of the locker unit used for the support assembly shown in FIG. 1.
Figure 7:
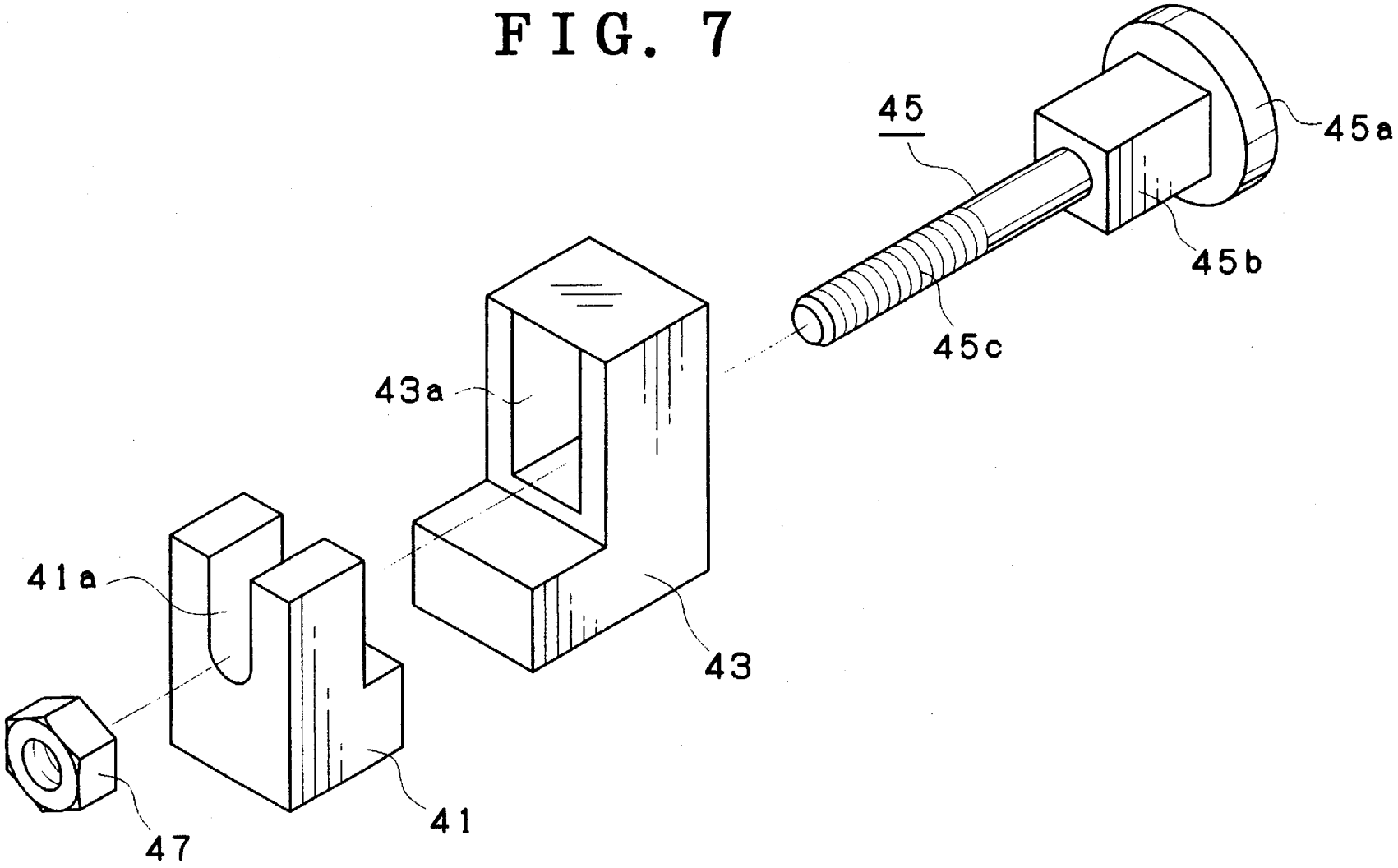
FIG. 7 is a perspective view of the locker unit shown in FIG. 6 in a disassembled state.

When the support arm 13 is registered at the operative position as shown in FIG. 6, the nut 47 is turned to fasten the fixer bolt 45 and the flange **45*a* of the latter is kept in pressure contact with the arm 43 in order to lock the entire system. For unlocking, the nut 47 is turned to loosen the fixer bolt 45. Next, the support bracket 13 is swung clockwise in the illustration and the fixer bolt 45 gets out of engagement with the pin stand 41 through the upper opening of the groove 41*a***. The bolt-nut combination produces less play than the pin-hook combination of the preceding example.

In accordance with the present invention, simple swing motion of the support bracket 13 about the drive shaft 9 can produce an enlarged free space above the planetary-type selvage unit during the looming operation. The lifting height of the heald frames for the looming operation can be minimized accordingly. This significantly reduces labour necessary for the looming operation, shorten the operation time and evades enlargement in construction of carries for automatic looming operation. Swing of the support bracket 13 carrying the sun shaft 11 about the drive shaft 9 allows no change in distance between the selvage and drive gear centers, thereby necessitating minimal change in mechanical design.

I claim:

1. A support assembly for a planetary gear train type selvage unit on a loom comprising a slide base adapted to be mounted atop a back top stay of said loom in an arrangement slidable in the width direction of said loom and adapted to rotatably carry a drive shaft for a drive gear of said planetary-type selvage unit, a support bracket having a proximal end adapted to be swingably mounted to said drive shaft and having a distal end adapted to support said planetary-type selvage unit, and a locker unit including a first element mounted to said slide base, a second element mounted to said support bracket and a third element for detachably engaging said first element with said second element, whereby said support bracket is adapted to be swingable on said drive shaft between an operative position suited for a weaving operation and a stand-by position suited for a looming operation.

2. A support assembly as claimed in claim 1 in which said first element is a pin, said second element is a fixer bolt, and said third element is a hook pivoted to said fixer bolt for engagement with said pin.

3. A support assembly as claimed in claim 1 in which said first element is a pin stand with a groove, said second element is an arm with a hole, and said third element is a fixer bolt adapted for engagement with said groove and hole.

4. A support assembly as claimed in claim 1 in which said support bracket is adapted to carry at said distal end a sun shaft for a selvage gear of said planetary-type selvage unit, whereby said selvage gear is kept in meshing engagement with said drive gear when said support bracket is swung between said operative and said standby positions.

* * * * *